US008846594B2

(12) United States Patent
Seita et al.

(10) Patent No.: US 8,846,594 B2
(45) **Date of Patent: *Sep. 30, 2014**

(54) ACID CLEANING STRIPPER WITH VISUAL DOSAGE AND RINSING INDICATOR

(76) Inventors: Victor Seita, Dammartin sur Tigeaux (FR); Roger Sicot, Paris (FR); Vincent Delaire, La Ferte-Sous-Jouarre (FR); Yann Denolle, Neuilly sur Seine (FR)

( * ) Notice: Subject to any disclaimer, the term of this patent is extended or adjusted under 35 U.S.C. 154(b) by 0 days.

This patent is subject to a terminal disclaimer.

(21) Appl. No.: 12/476,422

(22) Filed: Jun. 2, 2009

(65) Prior Publication Data

US 2009/0298733 A1 Dec. 3, 2009

(30) Foreign Application Priority Data

Jun. 2, 2008 (FR) ..... 08 53606

(51) Int. Cl.
*C11D 3/20* (2006.01)
*C11D 3/395* (2006.01)
*B08B 9/00* (2006.01)

(52) U.S. Cl.
USPC ..... 510/238; 510/195; 134/22.1

(58) Field of Classification Search
USPC ..... 510/238, 201, 253, 257, 100; 134/41, 134/40; 252/79.2
See application file for complete search history.

(56) References Cited

U.S. PATENT DOCUMENTS

| | | | | |
|---|---|---|---|---|
| 3,001,947 | A * | 9/1961 | Stahler et al. | 510/105 |
| 3,936,385 | A | 2/1976 | Cheng | |
| 4,016,089 | A | 4/1977 | Regan et al. | |
| 4,353,866 | A | 10/1982 | Wong | |
| 4,420,412 | A * | 12/1983 | Wong | 252/186.38 |
| 4,666,625 | A * | 5/1987 | Shaer et al. | 134/22.14 |
| 4,971,631 | A | 11/1990 | Sallee et al. | |
| 5,106,524 | A | 4/1992 | Haskell, III | |
| 5,424,000 | A * | 6/1995 | Winicov et al. | 510/100 |
| 5,759,974 | A | 6/1998 | Menke | |
| 6,551,985 | B1 * | 4/2003 | Bianchetti et al. | 510/475 |
| 2002/0004471 | A1 | 1/2002 | Rader et al. | |
| 2002/0187918 | A1 | 12/2002 | Urban | |
| 2005/0148480 | A1 * | 7/2005 | Croce | 510/201 |
| 2006/0257439 | A1 * | 11/2006 | Sabnis et al. | 424/401 |

FOREIGN PATENT DOCUMENTS

| | | | |
|---|---|---|---|
| EP | 1447461 | A | 8/2004 |
| FR | 1491654 | A | 8/1967 |
| WO | 2004/072327 | A1 | 8/2004 |

OTHER PUBLICATIONS

Gorman, S. A., et al., J. Chem. Soc. Perkin Trans 2, 2000:1889-1895.
Huang X.-L., et al., Analytica Chimica Acta 2006(580):55-67.
Karpiuk, J., Phys. Chem. Chem. Phys., 2003(5):1078-1090.
Non-Final Office Action dated Mar. 18, 2010 in co-pending U.S. Appl. No. 12/476,388.
Katiyar, S. S., Stabilization of malachite green in acid medium, Naturwissenschaften, 1962;49:325.
Lomonosov, S. A., et al., Intermolecular aggregation of triarylmethane dyes and its analytical important. Communication 9. Indication of pH with basic triphenylmetane dyes, Zhurnal Analiticheskoi Khimii, 1974;29 (7):1268-1270.
Belotserkovskaya, N. G., et al., The behavior of aminotriphenylcarbinols in acid media, Tr. Konf. po Probl. Primeneniya Korrelyatsion. Uravnenii v Organ, Khim., Tartusk, Gos. Univ., Tartu 1962;1:319-332.
Rumpf, P., et al., The spectra of the organic dye, malachite green, Bulletin de la Societe Chimique de France, 1995:101-103.
Skvortzov, V. N., Indicator changes of malachite green in concentrated alkali solutions, Zhumal Obhschei Khimii, 1934;4:1130-1137.
Office Action dated Apr. 1, 2011 in co-pending U.S. Appl. No. 12/476,422.
Final Office Action dated Nov. 23, 2011 received in copending U.S. Appl. No. 12/476,388.
Notice of Allowance dated Apr. 20, 2012 received in related U.S. Appl. No. 12/476,388.
Final Office Action dated Sep. 29, 2010 in co-pending U.S. Appl. No. 12/476,388.

* cited by examiner

*Primary Examiner* — Ling Choi
*Assistant Examiner* — Thuy-Ai Nguyen
(74) *Attorney, Agent, or Firm* — Pepper Hamilton LLP

(57) ABSTRACT

The present invention relates to a liquid stripper comprising a strong acid, and a colored indicator capable of assuming different colors, in particular for non measurable pH (i.e. below 1), depending on the acid concentration and on the polarity of the stripping solution, as well as to its use.

18 Claims, No Drawings

ACID CLEANING STRIPPER WITH VISUAL DOSAGE AND RINSING INDICATOR

CROSS-REFERENCE TO RELATED APPLICATIONS

This application claims priority under 35 U.S.C. §119(a) to French application Ser. No. 08/53606 filed Jun. 2, 2008, which is incorporated herein by reference in its entirety.

The present invention relates to a stripper based on a strong acid comprising a visual dosage indicator, in particular for non measurable pH (i.e. below 1), the said indicator serving also as rinsing check, i.e. as neutralisation check.

For surfaces which are difficult to clean or to strip, it is often necessary to use corrosive products based on a strong acid.

Depending on the surface to be cleaned, it will be preferable to use a more or less diluted acid solution. However, presently on the market, there is no cleaning and stripping product, for which the acid dosage may be easily observed, since there is no classical pH indicator having different changes of color in the range of pH of 0-1 which is the range of pH of interest for a cleaning and stripping application.

The inventors have thus discovered surprisingly that it was possible to add to an acid solution a colored indicator capable of assuming different colors, depending on the acid concentration and on the polarity of the stripping solution, in particular in the range of non measurable pH, i.e. in a range of pH below 1. Thus, it is easy to visually check the concentration of the stripper by means of the color of the solution obtained by dilution in water, in particular in the range of non measurable pH of interest, i.e. in the range of pH of 0-1. This colored indicator has the additional advantage of being able to be used also as a rinsing check since any coloration disappears at a neutral pH which indicates that the product has actually been removed, which is very important for corrosive products such as strong acids.

Such a colored indicator is different from a classical pH indicator in that the change of color is not due to the difference of color between an acid and its corresponding base and thus does not result from an acid-base equilibrium. Indeed, contrary to a classical pH indicator for which the change of color is determined by its pKa, the change of color does not arise at a predetermined pH whatever the kind of solution but depends also of the polarity of the solution.

Thus, the object of the present invention is a liquid stripper comprising:

- one or more strong acids, and
- a colored indicator capable of assuming different colors depending on the acid concentration and on the polarity of the solution of stripper, the changes of color being observed in the range of pH of 0-3, notably of 0-2, and advantageously of 0-1.

In fact, the range of pH in which the changes of color are observed can be adapted as desired, depending on the use of the final composition.

The polarity of the solution of stripper will depend on the nature and also on the polarity of optional additives added into the solution. According to the polarity of the solution, the colors obtained with a given colored indicator may be different or the changes in these colors may take place at different acid concentrations.

Advantageously, the colored indicator is capable of assuming at least two and preferably at least three, and still preferably at least four different colors, in addition to the fact that it is colorless at pH above 7, and preferably above 5. In these conditions, the colored indicator used in the present invention will be capable of assuming at least two, at least three, or at least four different colors in the range of pH of interest, i.e. in the range of pH of 0-3, notably of 0-2, and advantageously of 0-1.

By "strong acid", is meant, in the sense of the present invention, an acid which is totally dissociated in water. Strong acids are also characterized by the fact that their pKa in water is less than 0.

In particular, this will be a mineral acid such as sulfuric acid, hydrochloric acid, nitric acid, phosphoric acid or a mixture thereof. Advantageously, this will be hydrochloric acid, phosphoric acid or a mixture thereof, and preferably a mixture of hydrochloric acid and of phosphoric acid.

This acid will be used in a concentrated way in the present invention. In particular, the stripper will comprise at least 20%, preferably at least 30%, and still preferably at least 40% by weight of strong acid, relatively to the total weight of the stripper.

The colored indicator used in the present invention will be in the form of a carbocation in solution in the stripping agent (acid solution), and preferably in the form of a carbocation of the following formula (I):

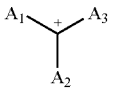

(I)

wherein $A_1$, $A_2$ and $A_3$ represent independently of each other, an aryl group, preferably phenyl, optionally substituted with one or more groups selected from a $(C_1\text{-}C_6)$ alkyl group, $—OR^1$, $—NR^2R^3$, $—SR^4$, $—CO_2H$ and $—SO_3H$, with:

- $R^1$ and $R^4$ representing independently of each other, a hydrogen atom, a $(C_1\text{-}C_6)$alkyl group, an aryl or aryl-$(C_1\text{-}C_6)$alkyl group, the aryl rings being optionally substituted with one or more groups selected from —OH, $(C_1\text{-}C_6)$alkoxy, $(C_1\text{-}C_6)$thioalkoxy, $(C_1\text{-}C_6)$alkyl, $—NR^5R^6$, $—CO_2H$ or $—SO_3H$, advantageously selected from $—CO_2H$ or $—SO_3H$, and preferably $—SO_3H$,
- $R^2$ and $R^3$ representing independently of each other a hydrogen atom, a $(C_1\text{-}C_6)$alkyl group, an aryl or aryl-$(C_1\text{-}C_6)$alkyl group, the aryl rings being optionally substituted with one or more groups selected from —OH, $(C_1\text{-}C_6)$alkoxy, $(C_1\text{-}C_6)$thioalkoxy, $(C_1\text{-}C_6)$alkyl, $—NR^5R^6$, $—CO_2H$ or $—SO_3H$, advantageously selected from $—CO_2H$ or $—SO_3H$, and preferably $—SO_3H$, or
- $R^2$ and $R^3$ forming together a $(C_4\text{-}C_7)$alkylene chain, and
- $R^5$ and $R^6$ representing independently of each other a hydrogen atom or a $(C_1\text{-}C_6)$alkyl group, or
- $R^5$ and $R^6$ forming together a $(C_4\text{-}C_7)$alkylene chain.

One skilled in the art will understand that the mesomeric forms of the carbocation (I) are also the object of the present invention since the carbocation (I) may be found in solution under several mesomeric forms by delocalization of the positive charge, notably on the aryl rings.

Besides, it seems that such a colored indicator in the form of a carbocation can change of color, in function of the pH and of the polarity of the solution, by delocalization of the charge, according to the speed at which the electrons move in the molecule. In these conditions, by changing of strong acid and especially by changing the polarity of the solution of the stripper, notably by using a surfactant, it is possible to obtain the changes of color in a desired range of pH, according to the use of the final stripper. This particularity seems to result of a mechanism of protection of the carbocation by electron transfer which prevents the early rearrangement of the carbocation in the below tertiary alcohol (II) which occurs with strong acid.

Moreover, it is to be noted that such a carbocation can react with an hydroxyl ion to form the following tertiary alcohol of the following formula (II):

(II)

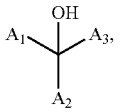

with $A_1$, $A_2$ and $A_3$ as defined above, such an alcohol being colorless. This particularity allows to use the colored indicator of the invention as a rinsing check since this reaction with the hydroxyl ion generally occurs around pH=5 in a solution of strong acid. But it is possible to modify the pH at which such a reaction occurs, notably by modifying the polarity of the solution, in order to observe a disappearance of the color notably at a pH comprised between 4 and 7, a pH between 5 and 7 being preferred.

By "alkyl", is meant in the sense of the present invention a linear or branched saturated, hydrocarbon chain.

By "($C_1$-$C_6$)alkyl", is meant in the sense of the present invention an alkyl group as defined above and including 1 to 6 carbon atoms. Advantageously, this is a methyl, ethyl, n-propyl, isopropyl, n-butyl, isobutyl, tert-butyl, pentyl or further hexyl. Preferably it is a methyl.

By "($C_1$-$C_6$)alkoxy", is meant, in the sense of the present invention, a group —OR wherein R represents a ($C_1$-$C_6$)alkyl as defined above. As an example, this may be a methoxy, ethoxy, isopropoxy, propoxy or even a tert-butoxy.

By "($C_1$-$C_6$)thioalkoxy", is meant, in the sense of the present invention, a group —SR' wherein R' represents a ($C_1$-$C_6$)alkyl as defined above. As an example, this may be a thiomethoxy, a thioethoxy, a thioisopropoxy, a thiopropoxy or even a thio-tert-butoxy.

By "($C_4$-$C_7$)alkylene" is meant, in the sense of the present invention, a $—(CH_2)_n—$ chain where n represents an integer comprised between 4 and 7, advantageously 4, 5 or 6, and preferably 4 or 5.

By "aryl", is meant in the sense of the present invention, an aromatic group, preferably including 5 to 10 carbon atoms and comprising one or more fused rings, such as for example a phenyl or naphthyl group. Advantageously, this is a phenyl.

By "aryl-($C_1$-$C_6$)alkyl", is meant in the sense of the present invention, an aryl group, as defined above bound to the molecule via a ($C_1$-$C_6$)alkyl group, as defined above. Advantageously this is a benzyl.

Advantageously, $A_1$, $A_2$ and $A_3$ represent independently of each other, a phenyl group, optionally substituted with one or several groups selected from a ($C_1$-$C_6$)alkyl group, —$OR^1$, —$NR^2R^3$, —$SR^4$, —$CO_2H$, and —$SO_3H$, $R^1$, $R^2$, $R^3$ and $R^4$ being as defined above.

Advantageously, the groups substituting the aryl or phenyl group of the radicals $A_1$, $A_2$ and $A_3$, if any, are located in the para position.

Advantageously, at least one, preferably at least two of the radicals $A_1$, $A_2$ and $A_3$ represent(s) an aryl group, preferably a phenyl, substituted with a —$NR^2R^3$ group, with $R^2$ and $R^3$ such as defined above, preferably in the para position.

Still advantageously, $A_1$, $A_2$ and $A_3$ represent independently of each other, an aryl group, preferably phenyl, optionally substituted with one or more —$NR^2R^3$ or —$SO_3H$ groups, with $R^2$ and $R^3$ as defined above, and advantageously in the para position.

Advantageously, the colored indicator will form one of the following carbocations in an acid solution:

(1)

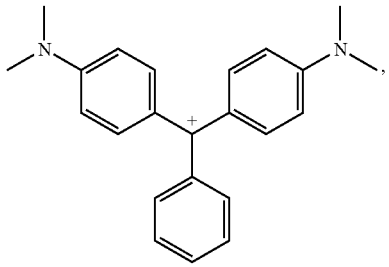

(2)

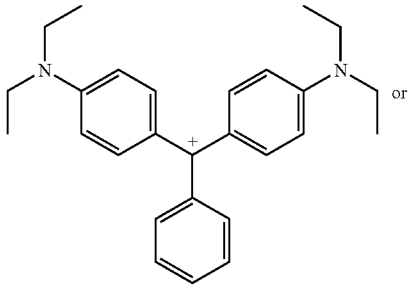

(3)

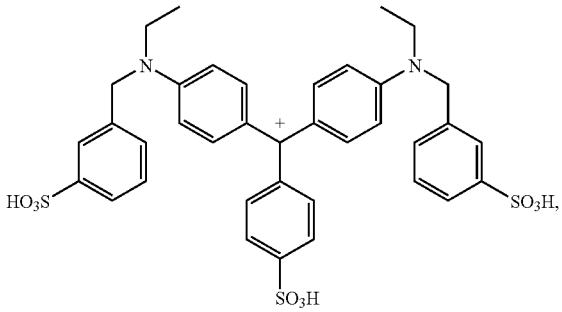

and preferably will form the carbocation (1).

These carbocations are obtained by addition in the stripper, of one of the following colored indicators: malachite green for (1), brilliant green for (2) or light green SF yellowish for (3), compounds which respectively fit the following formulae:

(1a)

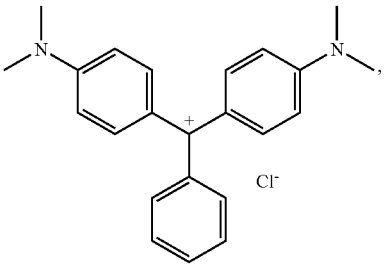

-continued (2a)

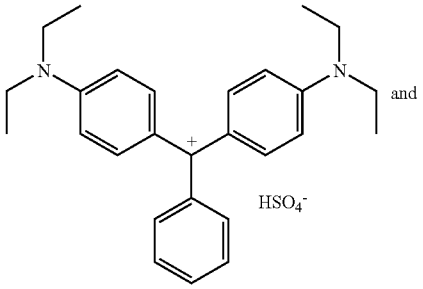

(3a)

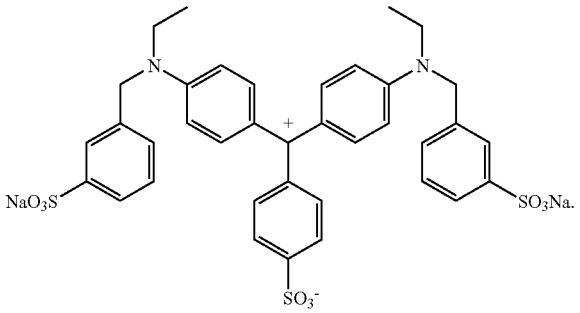

In a particular embodiment, the stripper will comprise from 0.005 to 0.5%, preferably from 0.001 to 0.02%, and advantageously about 0.01%, by weight of colored indicator, based on the total weight of the stripper.

Advantageously, a surfactant may be added to the stripper, preferably a surfactant of the anionic type.

Indeed, the inventors have surprisingly noticed that by adding a surfactant the obtained colors may be intensified, a larger palette of colors may be obtained and color transitions may be changed (notably, the changes of color arise in a more narrow range of pH). This provides thus the possibility of adjusting the acid concentration at which the color changes will take place. Without however having the intention of being limited by such an interpretation, the inventors assume that by adding such a surfactant, this changes the polarity of the acid solution, thereby allowing modification of the changes in color. Moreover, it seems that the addition of such a surfactant allows to limit the reaction of the carbocation with an hydroxyl ion to give the alcohol of formula (II) and thus to stabilize the carbocation. This could explain notably the obtaining of more intense colors.

Advantageously, the surfactant will be a salt of a ($C_1$-$C_{20}$) alkyl-aryl-sulfonic acid, a salt of an aryl-sulfonic acid, a salt of a ($C_2$-$C_{20}$)alkenyl-sulfonic acid, or a mixture thereof.

Advantageously, this will be a salt of a ($C_1$-$C_{20}$)alkyl-aryl-sulfonic acid, a salt of a ($C_2$-$C_{20}$)alkenyl-sulfonic acid, or a mixture thereof.

Still advantageously, this will be a salt of a ($C_1$-$C_{20}$)alkyl-aryl-sulfonic acid.

By "($C_1$-$C_{20}$)alkyl", is meant in the sense of the present invention, an alkyl group as defined above including 1 to 20 carbon atoms. Preferably, this will be a linear chain, advantageously including 12 carbon atoms (dodecyl group).

By "($C_2$-$C_{20}$)alkenyl", is meant in the sense of the present invention, a linear or branched hydrocarbon chain including at least one double bond and including 2 to 20 carbon atoms. Advantageously, the alkenyl will include only one double bond, preferably in the alpha position relatively to the sulfonic acid function. Still more advantageously, the alkenyl will include 12 to 14 carbon atoms.

By "salt", is meant in the sense of the present invention, a salt formed with the sulfonic acid function of the surfactant, i.e. a salt formed by replacing the acid proton of the sulfonic acid function by a metal ion, for example an alkaline metal ion ($Na^+$, $K^+$ or $Li^+$ for example), an earth alkaline metal ion (like $Ca^{2+}$ or $Mg^{2+}$) or an aluminium ion or by coordination of the sulfonic acid function with an organic or inorganic base. This salt may therefore be obtained by adding an organic or inorganic base to the sulfonic acid derivative. As an inorganic base, mention may be made of aluminium hydroxide, calcium hydroxide, potassium hydroxide, sodium carbonate and sodium hydroxide. As an organic base, mention may be made of amines such as diethanolamine, ethanolamine, N-methylglucamine, triethanolamine, tromethamine, triethylamine, isopropylamine, ammonia or the like.

In particular, the proton of the sulfonic acid function will be replaced with an alkaline metal ion, and in particular with $Na^+$, or will be coordinated to ammonia, in order to form an ammonium, to a monoalkylamine, to a dialkylamine, or to a trialkylamine. Advantageously, the proton will be replaced with an alkaline ion such as $Na^+$ or will be coordinated to ammonia or to a monoalkylamine, and preferably to a monoalkylamine.

By "monoalkylamine", is meant in the sense of the present invention, a primary amine of formula R—$NH_2$, wherein R represents a ($C_1$-$C_6$)alkyl chain as defined above. Preferably, this will be isopropylamine.

By "dialkylamine", is meant in the sense of the present invention, a secondary amine of formula RR'NH, wherein R and R' represent independently of each other a ($C_1$-$C_6$)alkyl chain as defined above.

By "trialkylamine", is meant in the sense of the present invention, a tertiary amine of formula RR'R"N, wherein R, R' and R" represent independently of each other a ($C_1$-$C_6$)alkyl chain as defined above. Advantageously, this will be triethylamine.

Advantageously, the surfactant will be the isopropylamine salt of dodecylbenzene-sulfonic acid (marketed under the name of Caflon® MIS by Univar) or a sodium alpha-($C_{12}$-$C_{16}$)alkenyl-sulfonate or a mixture thereof, such as a mixture of sodium alpha-alkenyl-sulfonates including 14 to 16 carbon atoms (marketed under the name of Ifrapon® AOS 38P by Ifrachimie). Preferably, this will be a mixture of sodium alpha-alkenyl-sulfonates including 14 to 16 carbon atoms.

Advantageously, the stripper will comprise up to about 5%, preferably 0.1-2% by weight of surfactant, based on the total weight of the stripper.

Advantageously, the stripper according to the invention may further comprise a polar solvent, preferably selected from water, a linear or branched ($C_1$-$C_6$)alcohol, optionally substituted with a linear or branched ($C_1$-$C_6$)alkoxy group, or a mixture thereof. The polar solvent will be preferably selected from water, ethanol, butylglycol and a mixture thereof.

By "alcohol", is meant in the sense of the present invention a linear or branched saturated hydrocarbon chain, including 1 to 6 carbon atoms, one of these carbon atoms being substituted with a hydroxyl group OH. Advantageously, this is ethanol.

By "alkoxy", is meant in the sense of the present invention a linear or branched saturated hydrocarbon chain including 1 to 6 carbon atoms, bound to the molecule, an alcohol in the case of the present invention, via an oxygen atom.

When the alcohol is substituted with an alkoxy group, this will advantageously be butylglycol.

In a particular embodiment, the stripper may comprise hydrochloric acid, phosphoric acid, malachite green, a mixture of sodium alpha-alkenyl-sulfonates including 14 to 16 carbon atoms, water and butylglycol.

The present invention also relates to the use of a stripper as defined above for treating, cleaning and stripping surfaces such as the ground, metal sheets, tanks such as concrete mixers, or boats, in particular for degreasing or removing rust, shells or cement deposits.

In particular, the use of the stripper according to the present invention will involve the dilution of said stripper in water until is obtained a characteristic color corresponding to the desired strong acid concentration adapted to the nature of the treatment, cleaning or stripping of surfaces to be carried out.

The present invention will be better understood with the help of the following examples which are only used for illustrating the invention and not for limiting the scope thereof.

EXAMPLE 1

A solution was prepared by mixing in 33% hydrochloric acid or in 96% sulfuric acid, fluorescein of the following formula:

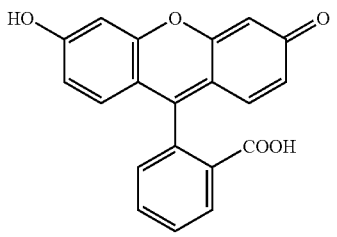

However, in this case, the acid solution assumes a yellow coloration and does not change color according to the acid concentration in the range of pH of 0-1.

Fluorescein therefore cannot be used as a colored indicator within the scope of the present invention.

EXAMPLE 2

A solution was prepared by mixing, in 33% hydrochloric acid or 96% sulfuric acid, helianthin of the following formula:

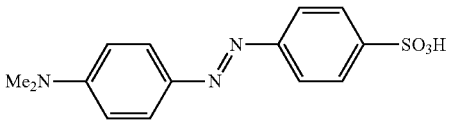

However, in this case, the acid solution assumes a red coloration and does not change color according to the acid concentration in the range of pH of 0-1.

Helianthin therefore cannot be used as a colored indicator within the scope of the present invention.

EXAMPLE 3

A solution was prepared by mixing, in 33% hydrochloric acid or in 96% sulfuric acid, bromothymol blue (BBT) of the following formula:

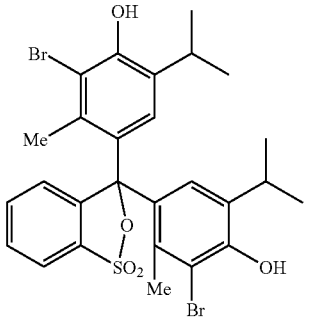

However, in this case, the strong acid solution remains colorless and does not change color according to the acid concentration in the range of pH of 0-1.

Bromothymol blue (BBT) therefore cannot be used as a colored indicator within the scope of the present invention.

EXAMPLE 4

A solution was prepared by mixing, in 33% hydrochloric acid or in 96% sulfuric acid, brilliant green.

In this case, the following colors are observed from the less concentrated to the most concentrated solution:

in the case of sulfuric acid:
orange-yellow-colorless,
in the case of hydrochloric acid:
orange-yellow-blue-colorless.

When a surfactant is added (Caflon® MIS or Ifrapon® AOS 38P), the following colors are observed:

in the case of sulfuric acid:
orange-yellow-green-colorless,
in the case of hydrochloric acid:
orange-yellow-green-blue-colorless.

All the changes of color are observed at a pH<1, except for the disappearance of the color.

EXAMPLE 5

A solution was prepared by mixing, in 33% hydrochloric acid or in 96% sulfuric acid, light green SF yellowish.

In this case, the following colors are observed, from the less concentrated to the most concentrated solution:

in the case of sulfuric acid:
orange-yellow-colorless,
in the case of hydrochloric acid:
orange-yellow-blue-colorless.

When a surfactant is added (Caflon® MIS or Ifrapon® AOS 38P), the following colors are observed:

in the case of sulfuric acid:
orange-yellow-green-colorless,
in the case of hydrochloric acid:
orange-yellow-green-blue-colorless.

All the changes of color are observed at a pH<1, except for the disappearance of the color.

EXAMPLE 6

A solution was prepared by mixing in 33% hydrochloric acid or in 96% sulfuric acid, malachite green.

In this case, we observe the following colors from the less concentrated to the most concentrated solution, these colors being a little brighter than in both previous cases (Examples 4 and 5):

in the case of sulfuric acid:
orange-yellow-colorless, in the case of hydrochloric acid:
orange-yellow-blue-colorless.

When a surfactant is added (Caflon® MIS or Ifrapon® AOS 38P), the following colors are observed:

in the case of sulfuric acid:
orange-yellow-green-colorless, in the case of hydrochloric acid
orange-yellow-green-blue-colorless.

All the changes of color are observed at a pH<1, except for the disappearance of the color.

It should be noted that depending on the nature and/or the concentration of the surfactant used, the color changes will not occur at the same acid concentrations.

The formulator will accordingly adapt the formulation depending on its particular destination.

EXAMPLE 7

Exemplary strippers according to the present invention were thus prepared according to the compositions given below:

Stripper 1:

| Compounds | Amounts (in kg) |
|---|---|
| Water | 107 |
| 33% hydrochloric acid | 600 |
| Butylglycol | 40 |
| Hexamethylene tetramine aqueous solution marketed as Hydrogal ® IC 600 by CFPI/Nufarm | 5 |
| Citric acid monohydrate | 75 |
| 75% phosphoric acid | 133 |
| PEG-8 decanol, marketed as Ifralan ® X1008L | 20 |
| Isopropylamine salt of dodecylbenzenesulfonic acid, marketed as Caflon ® MIS by Univar | 20 |
| Malachite green | 0.05 |

Stripper 2:

| Compounds | Amounts (in kg) |
|---|---|
| Water | 127 |
| 33% hydrochloric acid | 610 |
| Butylglycol | 40 |
| Hexamethylene tetramine aqueous solution marketed as Hydrogal ® IC 600 (by CFPI/Nufarm, France) | 5 |
| Citric acid monohydrate | 75 |
| 75% phosphoric acid | 133 |
| Mixture of sodium alpha-alkenyl-sulfonates including 14 to 16 carbon atoms, marketed as Ifrapon ® AOS 38P (by Ifrachimie, France) | 10 |
| Malachite green, | 0.075 |

When these strippers are diluted in water, they may assume the following colors, from the less concentrated to the most concentrated solution: blue, green, yellow and orange.

All the changes of color are observed at a pH<1. Moreover, when the pH is above 5, the coloration totally disappears, whereby it is possible to have a good indication of rinsing.

The invention claimed is:

1. A liquid stripper solution comprising:

one or more strong acid(s), wherein the one or more strong acid(s) is at least 20% by weight based on the total weight of the stripper solution, a colored indicator chosen from malachite green, brilliant green or light green SF yellowish, wherein the colored indicator is capable of assuming at least three different colors in the range of pH of 0-3, and wherein the colored indicator is colorless for pH above 7, and wherein the colored indicator is from 0.005 to 0.5% by weight based on the total weight of the stripper solution, and a surfactant selected from a salt of a ($C_1$-$C_{20}$)alkyl-aryl-sulfonic acid, a salt of an aryl-sulfonic acid, a salt of a ($C_2$-$C_{20}$)alkenyl-sulfonic acid or a mixture thereof, wherein the surfactant is up to about 5% by weight based on the total weight of the stripper solution.

2. The stripper solution according to claim 1, wherein the strong acid(s) is(are) sulfuric acid, hydrochloric acid, nitric acid, phosphoric acid or a mixture thereof.

3. The stripper solution according to claim 1, wherein the colored indicator is in the form of a carbocation in solution in the stripper solution.

4. The stripper solution according to claim 1, wherein it further comprises a polar solvent.

5. The stripper solution according to claim 1, wherein it comprises hydrochloric acid, phosphoric acid, malachite green, a mixture of sodium alpha-alkenyl-sulfonates including 14 to 16 carbon atoms, water and butylglycol.

6. A method of treating a surface comprising contacting the surface with the liquid stripper solution according to claim 1.

7. The method according to claim 6, wherein the liquid stripper solution is diluted in water until the characteristic color corresponding to the desired strong acid concentration adapted to the nature of the treatment, cleaning or stripping of surfaces to be carried out is obtained.

8. The stripper solution according to claim 1, wherein the colored indicator is capable of assuming at least four different colors in the range of pH of 0-3.

9. The stripper solution according to claim 1, wherein it comprises at least 30% by weight of strong acid based on the total weight of the stripper solution.

10. The stripper solution according to claim 1, wherein it comprises at least 40% by weight of strong acid based on the total weight of the stripper solution.

11. The stripper solution according to claim 1, wherein the colored indicator is malachite green.

12. The stripper solution according to claim 1, wherein it comprises from 0.001 to 0.02% by weight of colored indicator based on the total weight of the stripper solution.

13. The stripper solution according to claim 1, wherein it comprises from 0.1 to 2% by weight of surfactant based on the total weight of the stripper solution.

14. The stripper solution according to claim 4 wherein the polar solvent is water, a linear or branched ($C_1$-$C_6$)alcohol, optionally substituted with a linear or branched ($C_1$-$C_6$) alkoxy group, or a mixture thereof.

15. The stripper solution according to claim 14 wherein the polar solvent is water, ethanol, butylglycol, or a mixture thereof.

16. The method according to claim 6, wherein the surface is the ground, a metal sheet, a tank, or a boat.

17. A method of degreasing or removing rust, shells or cement deposits from a surface comprising contacting the surface with the liquid stripper solution according to claim 1.

18. The method according to claim 17, wherein the strong acid(s) is(are) sulfuric acid, hydrochloric acid, nitric acid, phosphoric acid or a mixture thereof, and the colored indicator is in the form of a carbocation in solution in the stripper solution.

* * * * *